US008674620B2

(12) United States Patent
Capodivacca et al.

(10) Patent No.: US 8,674,620 B2
(45) Date of Patent: Mar. 18, 2014

(54) MULTI CHANNEL LED DRIVER

(75) Inventors: Giovanni Capodivacca, Padua (IT); Fabrizio Cortigiani, Padua (IT); Andrea Scenini, Abano Terme (IT)

(73) Assignee: Infineon Technologies AG, Neubiberg (DE)

( * ) Notice: Subject to any disclaimer, the term of this patent is extended or adjusted under 35 U.S.C. 154(b) by 566 days.

(21) Appl. No.: 12/956,429

(22) Filed: Nov. 30, 2010

(65) Prior Publication Data

US 2012/0133299 A1 May 31, 2012

(51) Int. Cl.
*H05B 41/16* (2006.01)

(52) U.S. Cl.
USPC ..... 315/247; 315/185 S; 315/291; 315/307; 315/312

(58) Field of Classification Search
USPC ..... 315/247, 224, 225, 185 S, 209 R, 297, 315/307–326
See application file for complete search history.

(56) References Cited

U.S. PATENT DOCUMENTS 6,690,146 B2 2/2004 Burgyan et al.
8,193,757 B2 * 6/2012 Chen et al. ..... 320/101
2012/0313528 A1 * 12/2012 Chen et al. ..... 315/121

OTHER PUBLICATIONS

"LT3595—16 Channel Buck Mode LED Driver," Linear Technology, 2007, 4 pages.

* cited by examiner

*Primary Examiner* — Tuyet Thi Vo
(74) *Attorney, Agent, or Firm* — Slater & Matsil, L.L.P.

(57) ABSTRACT

A driver circuit includes a buck converter associated with each LED chain for supplying a load current thereto. The buck converter receives an input voltage and is configured to provide a supply voltage to the associated LED chain such that the resulting load current of the LED chain matches at least approximately a predefined reference current value. The driver circuit further includes a switching converter that receives a driver supply voltage from a power supply and provides, as an output voltage, the input voltage for the buck converters. The switching converter is configured to provide an input voltage to the buck converters such that the maximum of the ratios between the input voltage and the supply voltages provided to the LED chains matches a predefined tolerance reference ratio.

20 Claims, 2 Drawing Sheets

MULTI CHANNEL LED DRIVER

TECHNICAL FIELD

The invention generally relates to driver circuitry, in particular, to circuitry configured to drive illumination devices based on light emitting diodes (LEDs).

BACKGROUND

As light emitting diodes (LEDs) are increasingly used for illumination purposes, in particular, as a substitute for light bulbs, adequate driver circuitry has been subject to research and development in recent times. Inter alia, one desired object of such development efforts is to increase efficiency, that is to reduce power dissipation in the driver circuitry. Other development goals include, an increased flexibility of use and low costs.

One LED based illumination device usually includes a series circuit of a plurality of LEDs, a so-called LED chain. As LEDs usually have to be driven by a defined current, each LED in a LED chain is supplied with a fixed (not necessarily the same for all the LED chains) current. The supply voltage, necessary for driving the LED chain depends on the number of LEDs present in the chains because the forward voltages of each of the single LEDs sum up to the required supply voltage of the LED chain. It is known that the forward voltages may heavily vary due to temperature variations, variances in the manufacturing process and other parameters. As a consequence, the supply voltage necessary to provide a desired load current may vary and the driver circuitry used to drive the LED chain should consider such variations.

In order to guarantee a defined brightness and color hue, the supply current of the LED chain is to be monitored and regulated so as to stay at a predefined reference level or at least stay within a small interval around the reference level. Linear current regulators are commonly used for the described purpose of supplying a defined current to the LEDs. However, the driver circuit has to be designed for the worst case, that is for the maximum possible supply voltage which might occur across the LED chain. Such a design entails undesirably high losses in the above-mentioned current regulators.

SUMMARY OF THE INVENTION

A driver circuit for driving at least two LED chains is described. In accordance with an embodiment of the invention the driver circuit includes a buck converter associated with each LED chain for supplying a load current thereto. The buck converter receives an input voltage and is configured to provide such a supply voltage to the associated LED chain that the resulting load current of the LED chain matches at least approximately a predefined reference current value. The driver circuit further comprises a switching converter that receives a driver supply voltage from a power supply and provides, as an output voltage, the input voltage for the buck converters. The switching converter is configured to provide an input voltage to the buck converters so that the maximum of the ratios between the input voltage and the supply voltages provided to the LED chains matches a predefined tolerance reference ratio.

Further, a method for driving at least two LED chains is described. In accordance with a further embodiment of the invention the method includes providing a driver input voltage to a switching converter. The driver input voltage is converted into a common input voltage in accordance with a switching converter duty cycle. For each LED chain, in accordance with a buck converter duty cycle the common input voltage is converted into a supply voltage for the respective LED chain using a buck converter such that a resulting load current supplied to the LED chain matches a desired reference value. The switching converter duty cycle is regulated dependent on the buck converter duty cycles such that a maximum duty cycle of the buck converter duty cycles matches a predefined reference duty cycle.

BRIEF DESCRIPTION OF THE DRAWINGS

The invention can be better understood with reference to the following drawings and description. The components in the figures are not necessarily to scale, instead emphasis being placed upon illustrating the principles of the invention. Moreover, in the figures, like reference numerals designate corresponding parts. In the drawings.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Figure 1:
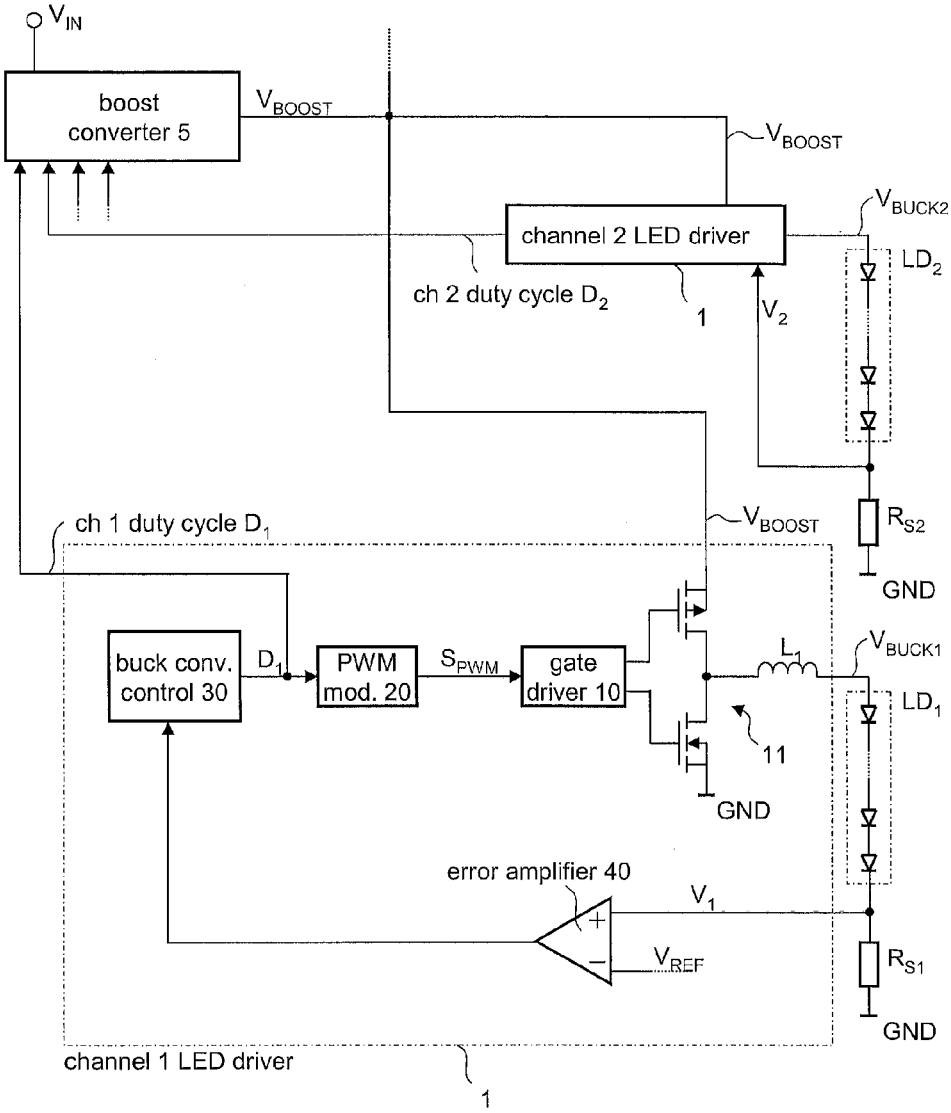
FIG. 1 illustrates a LED driver circuit in accordance with a first example of the invention including one boost converter and a plurality of buck converters.

FIG. 1 illustrates a LED driver circuit in accordance with a first embodiment of the present invention. The driver circuit is able to provide defined load currents to a plurality of LED chains $LD_1$, $LD_2$, etc., connected to the driver circuit. To provide the load currents to the LED chains $LD_1$, $LD_2$ the driver circuits include buck converters 1, wherein each LED chain is connected to the output of a corresponding buck converter 1 of the driver circuit. The buck converters 1 receive common input voltage $V_{BOOST}$ provided by a switching converter 5 which is, in the present example, a boost converter that is configured to convert a driver supply voltage $V_{IN}$ into an appropriate input voltage $V_{BOOST}$ for the buck converters 1.

In order to provide a defined current, the buck converters 1 may receive a current feedback signal $V_1$, $V_2$, from the connected LED chains $LD_1$, $LD_2$. The current feed back signals $V_1$, $V_2$, may be the voltage drop across a shunt resistor $R_{S1}$, $R_{S2}$ included in or connected to the respective LED chain $LD_1$, $LD_2$. Of course any other current measuring device connected to or included in the LED chains $LD_1$, $LD_2$ may be readily applied to generate respective current feed back signals $V_1$, $V_2$, that are representative for the load currents flowing through the respective LED chains $LD_1$, $LD_2$. Various current measurement methods may be readily applied to measure the current in the LED chains (for example, measuring the current in the inductance or across the buck switches or using a sense-FET arrangement or a shunt resistor in series to the buck switches). The buck converters 1 are configured to provide a supply voltage $V_{BUCK1}$, $V_{BUCK2}$ to the respective LED chains $LD_1$, $LD_2$ such that the load current through the respective LED chains $LD_1$, $LD_2$ matches a given reference current level which may be represented by a reference voltage $V_{REF}$.

In accordance with one embodiment of the present invention, the current feed back signal (e.g., signal $V_1$) received by a buck converter 1 is compared with a reference signal $V_{REF}$ that is representative of a desired current level. The difference between the actual load current (represented by current feedback signal $V_1$) and the reference current (represented by reference signal $V_{REF}$) may be seen as current error and be amplified by an error amplifier 40 that provides a corresponding error signal.

In addition to the error amplifier 40, the buck converter includes a buck converter control unit 30 that receives the (amplified) current error signal. The buck converter control unit 30 operates as a current regulator and is thus configured to derive a duty cycle $D_1$ dependent on the error signal. The duty cycle $D_1$ derived from the error signal is supplied to a modulator unit 20, which may be implemented as a pulse width modulator unit as illustrated in the example of FIG. 1.

The modulator unit 20 is configured to provide a binary (on/off) switching signal $S_{PWM}$ having a duty cycle $D_1$ as provided by the buck converter control unit 30. The switching signal $S_{PWM}$ may be provided to a driver circuit 10, which is configured to drive a corresponding switching unit 11 of the buck converter 1 in accordance with the switching signal $S_{PWM}$. The switching unit 11 may be a MOSFET half-bridge as commonly used in buck converters. However other types of switching units may be applicable such as, for example, a switching half bridge including one MOSFET in the high side branch and a diode in the low side branch. Usually, an inductor $L_1$ is connected between the output of the half bridge 11 and the load (LED chain) of the buck converter 1.

As explained above, each buck converter 1 includes a feedback loop for regulating the load current through the load (i.e., the respective LED chain). As the load current directly depends on the duty cycle of the switching signal $S_{PWM}$, the buck converter control unit 30 is configured to regulate, dependent on the above-mentioned error signal, the duty cycle such that the actual load current provided by the respective switching converter matches a desired predefined reference value.

The actual duty cycle $D_1$, $D_2$, etc., of each buck converter 1 is supplied to the switching converter 5 which generates a common input voltage $V_{BOOST}$ supplied the buck converters 1. In the present example the switching converter 5 is a boost converter that converts a driver supply voltage $V_{IN}$ (e.g., from an automotive battery) into the common input voltage $V_{BOOST}$ supplied to the buck converters 1. Depending on the application, the switching converter 5 may also be a buck-boost converter. If, for whatever reason, the forward voltage drop of an LED chain $LD_1$ rises, the corresponding buck converter 1 reacts by correspondingly increasing the duty cycle $D_1$ and thus augmenting the buck converter output voltage $V_{BUCK1}$ supplied to the LED chain $LD_1$ so as to keep the load current through the LED chain $LD_1$ at the desired level. Further, The switching converter 5 monitors the duty cycles $D_1$, $D_2$, etc. of the buck converters 1 connected downstream thereto and regulates its output voltage (which serves as common input voltage $V_{BOOST}$ for the buck converters) such that the duty cycle of the buck converter operating at the highest duty cycle matches a predefined desired value.

For the further explanation it is assumed that the first buck converter 1 is the buck converter operating at the highest duty cycle $D_1$. If the duty cycle $D_1$ increases such that it exceeds a predefined desired maximum duty cycle $D_{REF}$ then the switching converter will increase the input voltage $V_{BOOST}$ to the buck converters until the duty cycle $D_1$ has dropped again to or below the maximum duty cycle $D_{REF}$ (for example, $D_{REF}$=0.8 which means 80%). Such a duty cycle feedback to the switching converter 5 may be used for keeping the duty cycles $D_1$, $D_2$, etc., of the buck converters 1 in a limited range so as to provide sufficient margin (of 20% in the present example where $D_{REF}$=0.8) for upwardly adjusting the buck converter output voltage $V_{BUCK1}$.

Figure 2:
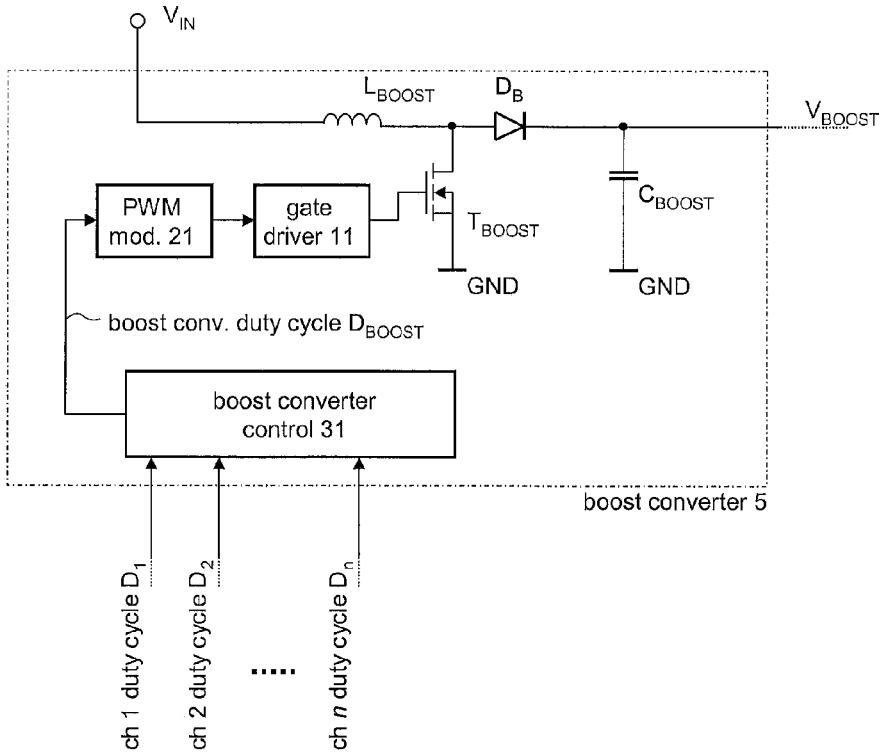
FIG. 2 illustrates the boost converter of FIG. 1 in more detail.

FIG. 2 illustrates an embodiment of the switching converter 5 of FIG. 1 whereby the switching converter 5 is implemented as a boost converter. Boost converters are typically used in automotive applications where the driver supply voltage $V_{IN}$ typically ranges between 11.9 V and 12.7 V and, however, a typical LED chain may require a supply voltage of 18 V or more (when including about ten LEDs). The boost converter 5 includes an inductor $L_{BOOST}$ supplied, at its first lead, with the driver supply voltage $V_{IN}$ while its second lead is connected to the boost converter output via diode $D_B$. To stabilize the boost converter output voltage $V_{BOOST}$, a (decoupling) capacitor $C_{BOOST}$ is coupled between the output terminal and a reference potential, e.g., ground potential GND. The common circuit node of inductor $L_{BOOST}$ and diode $D_B$ is coupled to reference potential (ground potential GND) via a semiconductor switch, e.g., a MOS transistor $T_{BOOST}$.

As the buck converters 1, the switching transistor is driven by a gate driver 11, which receives a switching signal from a modulator unit (e.g., a PWM modulator) whose duty cycle is determined by a control unit 31. The control unit (in the example of FIG. 2 denoted as boost converter control 31) receives the duty cycles $D_1$, $D_2$, etc., of all connected buck converters 1 and derives therefrom a boost converter duty cycle $D_{BOOST}$ supplied to the modulator unit 21. The boost converter duty cycle $D_{BOOST}$ is derived from the buck converter duty cycles $D_1$, $D_2$, etc. As mentioned above the boost converter duty cycle $D_{BOOST}$ and thus the boost converter output voltage $V_{BOOST}$ (being the common buck converter input voltage) is set such that the maximum duty cycle (e.g., $D_1$) of the buck converters 1 matches a desired maximum duty cycle $D_{REF}$. The boost converter control 31 ensures that the common input voltage $V_{BOOST}$ of the buck converters 1 is high enough so as the buck converters 1 do not assume a steady state with a duty cycle higher than the reference duty cycle $D_{REF}$.

Figure 3:
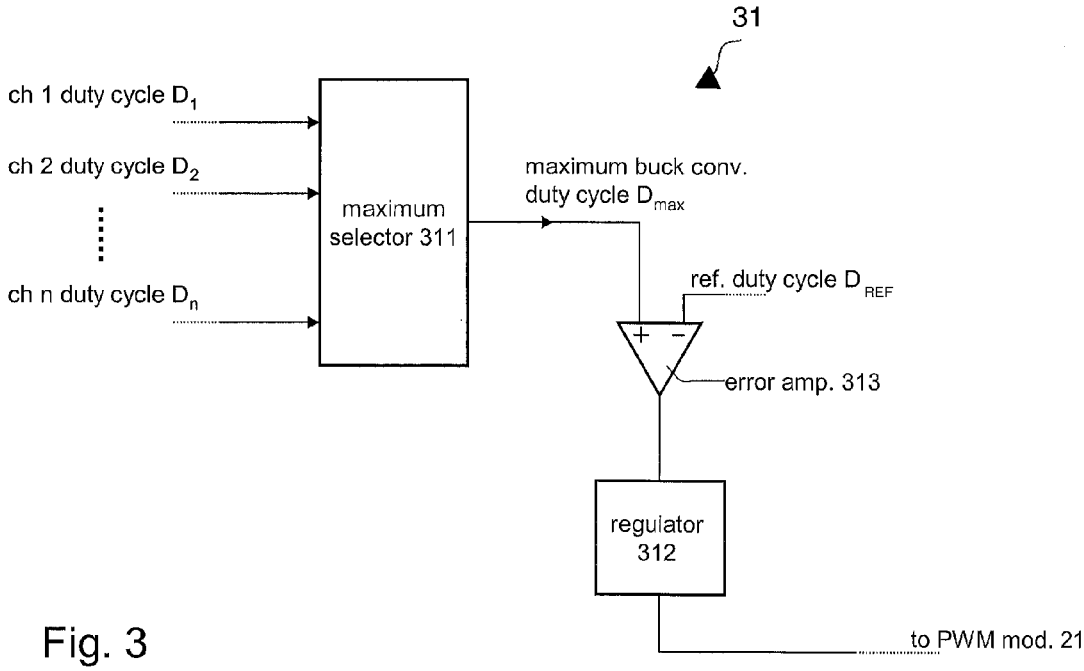
FIG. 3 illustrates the boost converter control used in the boost converter of FIG. 2 in more detail.

FIG. 3 illustrates one exemplary implementation of the boost converter control unit 31 in more detail. However, the present illustrations include only the details necessary for the explanation of the present example of the invention. Accordingly, the boost converter control unit 31 includes a maximum selector 311 that receives the values of the duty cycles $D_1$, $D_2$, etc., of all buck converters 1 supplied by the boost converter 5. The maximum selector 311 is configured to provide the maximum duty cycle value $D_{MAX}$ of the received duty cycles $D_1$, $D_2$, etc. The actual maximum duty cycle $D_{MAX}$ as well as the reference duty cycle $D_{REF}$ are supplied to a difference amplifier 313 that is configured to provide, as a duty cycle error signal, a signal proportional to the difference $D_{MAX}-D_{REF}$. The error signal is supplied to a regulator unit 312 which is connected to the PWM modulator 21 upstream thereof. The regulator 312 is configured to regulate the boost converter duty cycle $D_{BOOST}$ and thus the voltage $V_{BOOST}$ supplied to the buck converters 1 such that, in a steady state, the maximum duty cycle $D_{MAX}$ of the buck converters 1 matches a desired reference duty cycle. In this context the term "match" has to be understood such that the actual maximum duty cycle $D_{MAX}$ equals the desired reference duty cycle $D_{REF}$ or stays within a tolerance interval around the desired reference duty cycle $D_{REF}$. The regulator 312 may be of any common regulator type such as a P-regulator, a PI-regulator, or a PID-regulator (a digital PI-regulator has been used in experiments). Analog implementations may be used as well as digital regulators implemented using a micro controller or a digital signal processor executing appropriate software.

Although various exemplary embodiments of the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. It should be mentioned that features explained with reference to a specific figure may be combined with features of other figures, even in those where not explicitly been mentioned. Further, the methods of the invention may be achieved in either all software implementations, using the appropriate processor instructions, or in hybrid implementations that utilize a combination of hardware logic and software logic to achieve the same results. Such modifications to the inventive concept are intended to be covered by the appended claims.

What is claimed is:

1. A driver circuit for driving at least two LED chains, the driver circuit comprising:

at least two buck converters, each buck converter associated with an LED chain and coupled to supply a load current to the associated LED chain, each buck converter coupled to receive an input voltage and being configured to provide a supply voltage to the associated LED chain such that a resulting load current of the LED chain at least approximately matches a predefined reference current value; and a switching converter coupled to receive a driver supply voltage from a power supply and configured to provide, as one output voltage, the input voltage for the buck converters, the switching converter being configured to provide the input voltage to the buck converters such that a maximum of the ratios between the input voltage and the supply voltages provided to the LED chains matches a predefined reference ratio.

2. The driver circuit of claim 1, wherein:

the ratio between the input voltage and the corresponding supply voltage provided by a buck converter to the associated LED chain is determined by a duty cycle of the buck converter; and the switching converter is configured to provide an input voltage to the buck converters such that the duty cycle of the buck converter operating at the highest duty cycle matches a predefined reference duty cycle.

3. The driver circuit of claim 2, wherein:

the input voltage supplied to the buck converters by the switching converter is determined by a switching converter duty cycle; and the switching converter includes a control unit that is configured to receive the duty cycle values from the connected buck converters and to derive therefrom the switching converter duty cycle such that, in a steady state, the maximum duty cycle of the buck converters matches the predefined reference duty cycle.

4. The driver circuit of claim 3, wherein the control unit includes a maximum selector receiving the actual duty cycle values from the connected buck converters and providing the maximum duty cycle value.

5. The driver circuit of claim 4, wherein the control unit further includes a difference amplifier providing an error signal that is proportional to the difference between the maximum duty cycle value and a desired reference duty cycle value.

6. The driver circuit of claim 5, further comprising a switching converter duty cycle regulator unit coupled between the difference amplifier and a switching converter modulator unit, the regulator unit being configured to provide a switching converter duty cycle such that, in a steady state, the maximum duty cycle of the buck converters matches the predefined reference duty cycle.

7. A method for driving at least two LED chains, the method comprising:

providing a driver input voltage to a switching converter;

converting the driver input voltage into a common input voltage in accordance with a switching converter duty cycle;

for each LED chain, converting the common input voltage into a supply voltage for the respective LED chain using a buck converter in accordance with a buck converter duty cycle such that a resulting load current supplied to the LED chain matches a desired reference value; and regulating the switching converter duty cycle dependent on the buck converter duty cycles such that a maximum duty cycle of the buck converter duty cycles matches a predefined reference duty cycle.

8. The method of claim 7, wherein regulating of the switching converter duty cycle further comprises:

determining, from all buck converter duty cycles, the maximum buck converter duty cycle;

determining an error signal representing the difference between the maximum buck converter duty cycle and a desired reference duty cycle; and regulating the switching converter duty cycle in accordance with the error signal.

9. The method of claim 8, wherein the switching converter duty cycle is increased when the maximum buck converter duty cycle exceeds the desired reference duty cycle by more than a first given amount, and wherein the switching converter duty cycle is decreased when the maximum buck converter duty cycle falls below the desired reference duty cycle by more than a second given amount.

10. The method of claim 8, wherein the first given amount is the same as the second given amount.

11. The method of claim 8, wherein the switching converter duty cycle is regulated such that the error signal is reduced.

12. A circuit comprising:

a first LED driver comprising:

a first error amplifier;

a second buck converter control circuit coupled to an output of the first error amplifier;

a first driver circuit with an input coupled to an output of the buck converter control circuit; and a first LED driver output coupled to an output of the first driver, the first LED driver output configured to be coupled to a first LED chain;

a second LED driver comprising:

a second error amplifier;

a second buck converter control circuit coupled to an output of the second error amplifier;

a second driver circuit with an input coupled to an output of the second buck converter control circuit; and a second LED driver output coupled to an output of the second driver, the second LED driver output configured to be coupled to a second LED chain; and a switching converter with a first input coupled to the output of the first buck converter, with a second input coupled to the output of the second buck converter and an output coupled to the first and second driver circuits.

13. The circuit of claim 12, wherein each buck converter control circuit comprises a current regulator.

14. The circuit of claim 13, wherein the first LED driver further comprises a first modulator unit coupled between the first buck converter control circuit and the first driver circuit and wherein the second LED driver further comprises a second modulator unit coupled between the second buck converter control circuit and the second driver circuit.

15. The circuit of claim 14, wherein the first driver circuit comprises a first gate driver coupled to receive a switching signal from the first modulation unit and a first switching unit with an input coupled to an output of the first gate driver; and the second driver circuit comprises a second gate driver coupled to receive a switching signal from the second modulation unit and a second switching unit with an input coupled to an output of the second gate driver.

16. The circuit of claim 12, further comprising:

a first inductor coupled between the first LED driver output and the output of the first driver; and a second inductor coupled between the second LED driver output and the output of the second driver.

17. The circuit of claim 12, wherein the switching converter comprises a boost converter.

18. The circuit of claim 17, wherein boost converter comprises:

a boost converter control circuit that includes the first input and the second input of the switching converter;

a modulation unit with an input coupled to an output of the boost converter control circuit;

a gate driver with an input coupled to an output of the modulation unit;

a boost transistor with a control input coupled to an output of the gate driver, the boost transistor having a current path between a reference voltage node and the output of the switching converter;

a boost inductor coupled between an input voltage and the output of the switching converter; and a boost capacitor coupled between the output of the switching converter and the reference voltage node.

19. The circuit of claim 18, wherein the boost converter control circuit comprises:

a maximum selector circuit that includes the first input and the second input of the switching converter;

an error amplifier with a first input coupled to an output of the maximum selector circuit and a second input coupled to a reference signal; and a regulator with an input coupled to an output of the error amplifier, wherein an output of the regulator is coupled to the output of the boost converter control circuit.

20. The circuit of claim 18, further comprising a diode coupled between the current path of the boost transistor and the output of the switching converter.

* * * * *